United States Patent [19]

Hendricks

[11] Patent Number: 4,548,104

[45] Date of Patent: Oct. 22, 1985

[54] ADJUSTABLE SELF LOCKING CROW FOOT WRENCH

[76] Inventor: Perry L. Hendricks, P.O. Box 4B, Farmersville, Ill. 62533

[21] Appl. No.: 638,573

[22] Filed: Aug. 7, 1984

[51] Int. Cl.[4] ..... B25B 13/16

[52] U.S. Cl. ..... 81/165; 81/133; 81/170; 81/DIG. 3; 81/DIG. 8

[58] Field of Search ..... 81/133, 155, 163, 165, 81/170, 129, 138–139, DIG. 3, DIG. 8, 129 S, 81/130 R, 130 A

[56] References Cited

U.S. PATENT DOCUMENTS

| | | | |
|---|---|---|---|
| 986,112 | 3/1911 | Wood . | |
| 1,367,408 | 2/1921 | McClurkin | 81/165 |
| 2,358,362 | 4/1944 | Taylor . | |
| 2,600,617 | 6/1952 | Coates | 81/165 |
| 2,699,082 | 2/1955 | Viets . | |
| 2,708,855 | 5/1955 | Fish . | |
| 2,715,347 | 8/1955 | Johnson . | |
| 3,905,256 | 9/1975 | Foley | 81/165 |
| 4,277,991 | 7/1981 | Stubenrauch | 81/163 |

FOREIGN PATENT DOCUMENTS

| | | |
|---|---|---|
| 431061 | 7/1924 | Fed. Rep. of Germany . |
| 2355615 | 2/1978 | France . |
| 618203 | 4/1945 | United Kingdom . |

*Primary Examiner*—Frederick R. Schmidt
*Assistant Examiner*—Debra S. Meislin
*Attorney, Agent, or Firm*—McCaleb, Lucas & Brugman

[57] ABSTRACT

An adjustable, self-locking crow foot wrench comprises a support member having a pair of movable jaws. A worm adjustment member is rotatably journaled on the support member and engages rack teeth on the jaws to adjust their spacing for different size bolts. A locking element, guided for movement between the worm adjustment member and a drive-stud-receiving recess, is movable into locking engagement with the worm adjustment member in response to insertion of a drive stud into the recess. A spring moves it out of locking engagement in response to removal of the drive stud. In a two-piece embodiment, the support member is a portion of one of the jaws; in a three-piece embodiment, it is a third part.

9 Claims, 8 Drawing Figures

ADJUSTABLE SELF LOCKING CROW FOOT WRENCH

BACKGROUND OF THE INVENTION

This invention belongs to the field of tools and particularly to threaded slidable jaw adjustment wrenches, PTO Class 81, Subclasses 155, 163, 165 and 170.

A typical socket wrench set has a plurality of socket wrenches, each sized for a specific bolt, a socket wrench drive handle and one or more extensions, each with a drive stud. Each socket wrench has at one end a hexagonal socket opening for a specific size bolt, and has at the opposite end a drive-studreceiving recess. Socket wrench drive handles are available in a variety of shapes and styles including L and T shapes, ratchet drives, and there are straight extensions of different lengths. Each has a drive stud at one end which fits into the drive stud receiving recess in each socket wrench.

The utility of a socket wrench drive handle can be extended by means of a set of crow foot wrenches. These are short, open-ended wrenches, each with a drive-stud-receiving recess. Crow foot wrenches add versatility to a drive handle by enabling it to work in a hard-to-reach place where a socket wrench would not fit. A ratchet drive handle of the ratchet type provides quick, easy movement in tight quarters, plus the transverse accessibility of an open ended wrench.

Typically, crow foot wrenches are in sets of ten or so, each in a different bolt size. As with any set of loose, differently-sized parts, there is always a problem of keeping the set intact. To avoid this problem, adjustable crow foot wrenches have been proposed so a single wrench can be used on a range of different sized bolts. Examples are shown in U.S. Pat. Nos. 2,600,617 and 4,277,991. These have an adjustment worm member which is manually rotatable to make the jaws fit a particular bolt size. This is somewhat comparable to the worm adjustment utilized on crescent wrenches which has a serious drawback in that it loosens in use and constantly requires retightening. On a crescent wrench, although a nuisance, this can be tolerated; but for a crow foot wrench, possibly on the end of a long extension in an awkward, out-of-the-way location, this would not be practicable.

SUMMARY OF THE INVENTION

A general object of the present invention is to provide an adjustable crow foot wrench to fit a range of bolt sizes.

Another object is to provide an adjustable crow foot wrench which is self locking to hold an adjustment for a selected bolt size.

Another object is to provide an adjustable crow foot wrench which is automatically self locking at any selected bolt size in response to attachment of a socket wrench drive handle or extension, and which is automatically unlocking in response to detachment of the drive handle or extension.

Another object is to provide an adjustable, self locking crow foot wrench having a pair of jaws which are relatively slidable to fit different size bolts, a manual worm adjustment member rotatable to vary the jaw spacing, a drivestud-receiving recess, a locking element between that recess and the worm adjustment member, and mechanism responsive to insertion of a drive stud or extension into the recess to activate the locking element to engage the worm adjustment member and thereby lock it against rotation.

BRIEF DESCRIPTION OF THE DRAWINGS

Other objects and advantages will be apparent from the following description taken in connection with the accompanying drawings in which.

DESCRIPTION OF THE PREFERRED EMBODIMENTS

Figure 1:
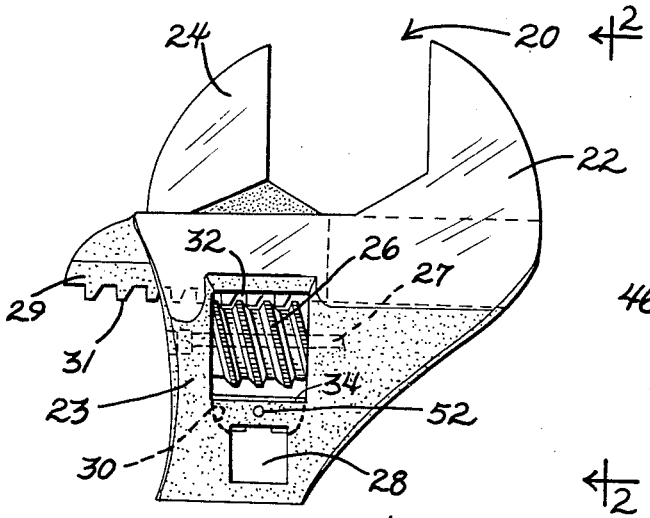
FIG. 1 is a top plan view of an adjustable self locking crow foot wrench in accordance with the present invention.
Figure 7:
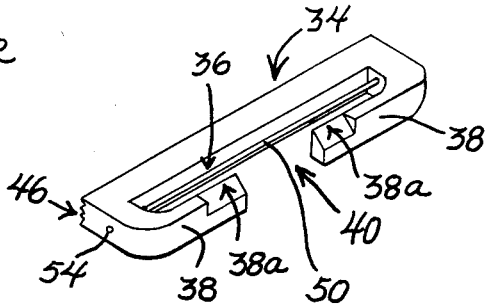
FIG. 7 is an enlarged perspective view of the locking element shown in some of the previous figures.
Figure 8:
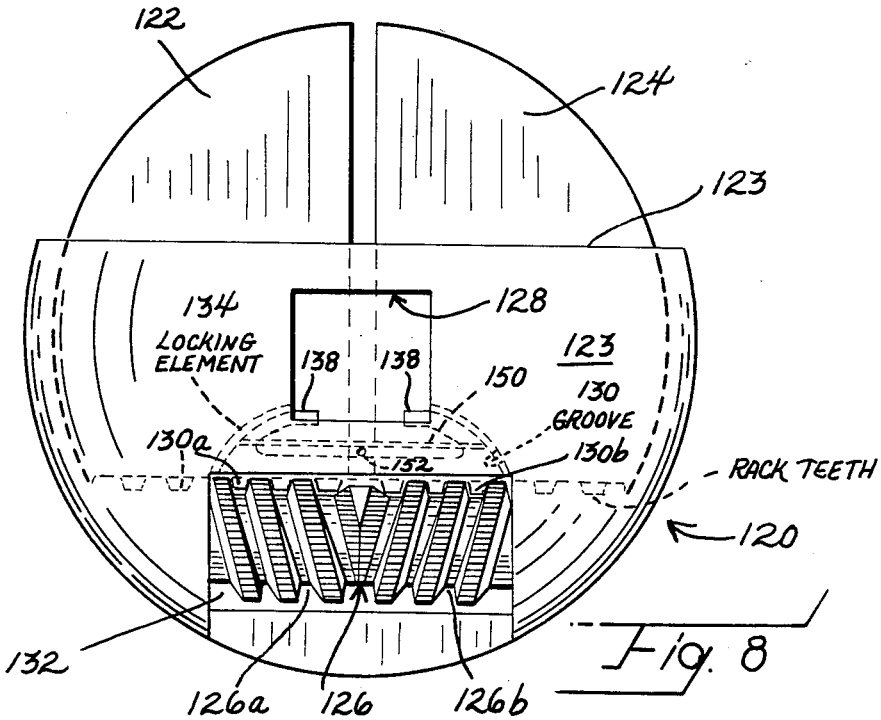
FIG. 8 is a top plan view of another embodiment of the invention.

Referring now more specifically to the adjustable self locking crow foot wrench invention shown in the drawings, FIGS. 1–7 show a two piece embodiment generally designated 20 and FIG. 8 shows a three piece embodiment 120.

The wrench 20 comprises a pair of jaws 22, 24 slidably interconnected for relative movement to fit bolts of different sizes.

Figure 2:
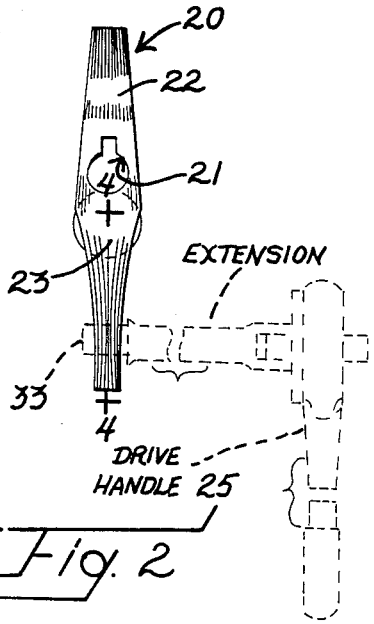
FIG. 2 is a right side view of FIG. 1 with an attached ratchet type drive handle shown in broken lines.

Jaw 22 has an internal guide bore 21 and a shank or extended portion 23 which provides an effective support member connecting the wrench 20 to a drive handle and extension such as that indicated 25 and 35 respectively and shown in broken lines in FIG. 2. This support or shank portion 23 has a manual worm adjustment gear member 26 rotatably journaled about a spindle 27 in a worm gear opening 32 located closely adjacent a drive-stud-receiving recess 28.

The other jaw 24 has an integral rack portion 29 extending along its base slidably engaged within the guide bore 21 in jaw 22. Rack teeth 31 engage the helical threads of worm adjustment member 26. Thus, the latter comprises a manually movable adjustment member for adjusting the spacing between the jaws to fit bolts of different sizes.

A similar worm gear and rack arrangement is commonly provided on crescent wrenches. A disadvantage is that, as a crescent wrench is used, the worm backs off, opens the jaws, and must be reset from time to time. This can be a nuisance but will be tolerated for short time use. Where a mechanic is working on a readily accessible bolt or nut with a crescent wrench he can keep the adjustment worm snugged up regularly with his thumb. However for extended use or where access is limited, mechanics often prefer a fixed jaw, open ended wrench which will not require constant resetting. This of course obviates the main reason for using a crescent wrench which is its adjustability.

Crow foot wrenches are highly specialized, often used on a nut or bolt in extremely limited quarters, typically behind a pipe, rod, or other obstruction where there is no straight-in access for a socket wrench and insufficient room to swing an open ended, crescent, or box wrench.

A crow foot wrench is inoperable by itself because it is too short. A square cross section drive stud 33 on a drive handle or extension, as shown in FIGS. 2 and 5, must be inserted in the drive stud receiving recess 28 to complete an operative assembly capable of tightening or loosening a bolt.

Figure 5:
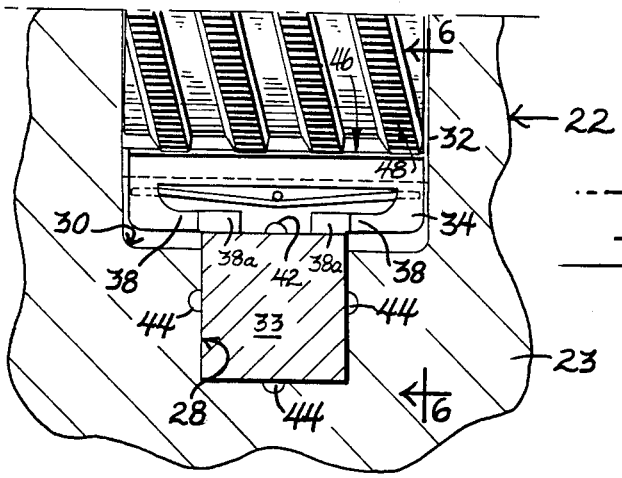
FIG. 5 is a view similar to FIG. 4 in the locked condition.

An important part of the present invention is the means for locking the worm adjustment gear member 26 against rotation in response to inserting the drive stud 33 in the recess 28 as shown in FIG. 5. This automatically locks the worm adjustment gear member against rotation and fixes the spacing between the jaws to fit a selected size bolt but automatically unlocks the worm adjustment gear member when the drive stud is removed. This important automatic locking and unlocking feature will now be described.

An internal groove 30 is milled, cast or otherwise formed in the support portion 23 of jaw 22 and extends between the worm gear opening 32 and the drive stud receiving recess 28.

A locking element 34 is guided for limited movement within the groove 30. As best shown in FIGS. 4, 5, 6 and 7, this comprises a flat plate-like body with a central opening 36 and a pair of inwardly directed, flexible, cantilevered prongs 38, 38 with a space 40 between their ends. An inclined upper cam face **38*a* on each prong 38 is engaged by the corners of the drive stud when it is inserted in the recess 28 thereby displacing the locking element 34 forwardly toward the worm gear 28 in response to insertion of the drive stud 33 as will be explained. The space 40 between the prongs provides clearance for a detent ball 42 (FIG. 5) if the ball happens to be oriented in that direction when the drive stud is inserted in the recess. Otherwise it will engage one of the small detent concavities 44** in the walls of the recess.

Figure 6:
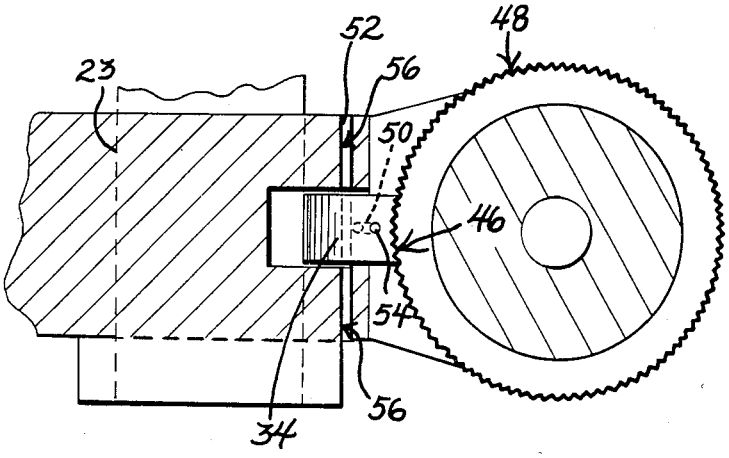
FIG. 6 is a fragmentary sectional view of FIG. 5 taken along line 6—6.

Although not essential to the invention, the locking element 34 may have fine, longitudinal teeth or knurling 46 engageable with similar fine knurled teeth 48 which are commonly provided on the outer surfaces of the worm gear threads. These fine knurled surfaces are best shown in FIGS. 6 and 7.

Figure 3:
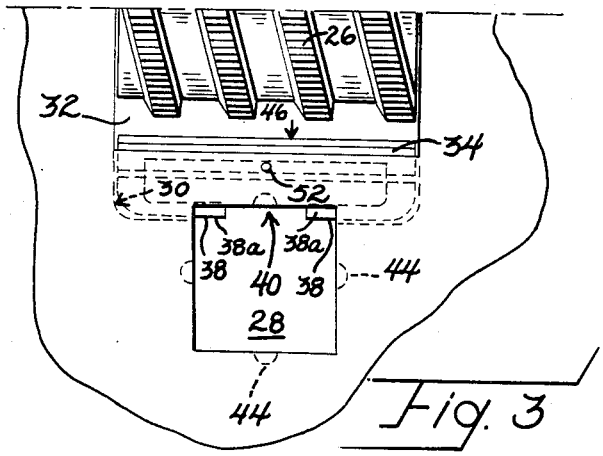
FIG. 3 is a fragmentary enlarged view of FIG. 1.
Figure 4:
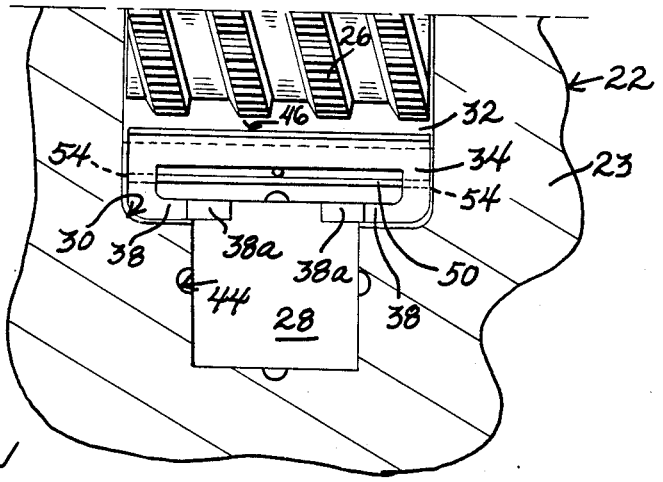
FIG. 4 is a fragmentary enlarged cross-sectional view of FIG. 2 taken on line 4—4.

A straight spring wire 50 is assembled within the central opening 36 of the locking element simply by inserting it through two holes 54, 54 drilled at opposite ends. The locking element is assembled within the central opening 36 before the worm gear 26 is assembled in the opening 32. The locking element is then held in place by a transverse pin 52 extending through the central opening and through holes 56 drilled in opposite portions of the jaw support or shank portion 23. The spring wire 50 biases the locking element 34 backward, away from the surface of the worm adjustment gear member 26, to the unlocked position shown in FIGS. 3 and 4, where the worm is free to rotate under manual adjustment. The cam surfaces **38*a* of prongs 38 extend into the edges of the socket recess 28 when the latter is empty, as best shown in FIGS. 3 and 4 where they are in position to be engaged by the drive stud 28 when inserted in the recess. When the drive stud is so inserted, it engages the cam surfaces 38*a*, displaces the locking element forwardly into engagement with the worm gear as shown in FIGS. 5 and 6. The teeth 46 and 48 engage one another and positively lock the worm gear against casual or accidental rotation as long as the drive stud 33** is in place.

In operation, the spring wire 50 biases the locking element 34 backward to the unlocked position shown in FIGS. 3 and 4 at which time the adjustment worm gear can be rotated freely by hand to adjust the spacing between the jaws 22, 24 to fit a particular bolt or nut size.

The simple act of inserting the drive stud 33 into the drive stud receiving recess 28 engages the prongs 38, 38 and displaces the locking element forwardly to engage the teeth 46 with the worm gear teeth 48 as best shown in FIGS. 4 and 5. The little wire spring 50 bends to accomodate this movement as shown in FIG. 4. The prongs 38 may be made slightly flexible to accomodate any dimensional variations from one wrench to another.

Referring now to the three piece embodiment 120 shown in FIG. 8, this comprises a support member 123 with a drive stud receiving recess 128 and an opening 132 within which a double helical worm adjustment gear member 126 is rotatably journaled. The latter has two, oppositely directed right and left hand thread sections **126*a* and 126*b* which are engaged with rack teeth 130*a* and 130*b* of jaws 122 and 124, respectively. A locking element 134, similar to element 34, is located in a guide groove 130 provided between the stud receiving recess 128 and worm gear opening 132. Components similar to the FIG. 1–7 embodiment are indicated by the same numerals, plus 100. (In other words, prongs 138 in FIG. 8 are counterparts of prongs 38 in the previous figures.) The locking element 134 comprises a pair of rear flexible prongs 138, 138 and has a straight flexible wire 150 engaged by a pin 152 biasing the locking element toward an unlocked position shown in FIG. 8**.

Operation is the same as described for the embodiment of FIGS. 1–7. Briefly, jaws 122, 124 can be adjusted to fit a selected size bolt by rotating the double worm gear 126. Inserting a drive stud from a drive handle or extension into the drive stud receiving recess 128 displaces the locking element 134 forwardly to engage the worm gear and lock it against rotation. The wire spring 150 automatically moves the locking element rearwardly to the unlocked position when the drive stud is removed from the drive stud receiving recess 128.

The embodiments described and shown to illustrate the present invention have been necessarily specific for purposes of illustration. Alterations, extensions and modifications would be apparent to those skilled in the art. The aims of the appended claims, therefore, is to cover all variations included within the spirit and scope of the invention.

The embodiments of the invention in which an exclusive property or privilege is claimed are defined as follows:

1. An adjustable, self-locking crow foot wrench comprising:

a support member;

the support member having a pair of jaws mounted for relative movement to fit bolts of different sizes, a manually movable adjustment member, means to adjust the spacing between the jaws in response to movement of the adjustment member, and a drive-stud-receiving recess; and means responsive to insertion of a drive stud into the recess to lock the adjustment member against movement and thereby fix the spacing between the jaws to fit a selected size bolt.

2. An adjustable, self-locking crow foot wrench according to claim 1 including means responsive to removal of a drive stud from the drive-stud-receiving recess to unlock the adjustment member enabling it to be moved to vary the spacing between the jaws.

3. An adjustable, self-locking crow foot wrench according to claim 1 in which:

said means responsive to insertion of a drive stud into the drive-stud-receiving recess comprises a locking element carried by the support member and extending between the recess and the adjustment member, and means for actuating the locking element to engage the adjustment member when the drive stud is inserted in the recess.

4. An adjustable, self-locking crow foot wrench comprising:

a support member;

a pair of jaws mounted on the support member and being slidably interconnected to vary the spacing therebetween to fit bolts of different sizes;

a manual worm adjustment member rotatably journaled on the support member and means to vary the spacing between the jaws in response to rotation of the worm adjustment member;

a drive-stud-receiving recess in the support member;

a locking element carried by the support member and extending between the recess and the worm adjustment member; and means responsive to insertion of a drive stud in the recess to actuate the locking element to engage the worm adjustment member and thereby lock it against rotation.

5. An adjustable, self-locking crow foot wrench according to claim 4 including means for actuating the locking element to disengage the worm adjustment member in response to removal of the drive stud from the recess and thereby unlock the worm adjustment member enabling it to be rotated to vary the spacing between the jaws.

6. An adjustable, self-locking crow foot wrench according to claim 4 including means to guide the locking element for movement toward and away from the worm adjustment member.

7. An adjustable, self-locking crow foot wrench according to claim 6 including interengaging teeth on the worm adjustment member and locking element respectively.

8. An adjustable, self-locking crow foot wrench according to claim 4 in which the locking element is located in a groove in the support member with one end of the locking element being extendible into the recess, means for moving the locking element from the recess to a locked position into locking engagement with the worm adjustment member in response to insertion of a drive stud into the recess, and means for moving the locking element to an unlocked position out of locking engagement with the worm adjustment member into the recess in response to removal of a drive stud from the recess.

9. An adjustable, self-locking crow foot wrench according to claim 8 in which said means for moving the locking element to an unlocked position comprises a spring acting between the support member and the locking element.

* * * * *